United States Patent [19]

Lundblad

[11] Patent Number: 4,662,621

[45] Date of Patent: May 5, 1987

[54] AUTOMATIC BANKNOTE DEPOSITING APPARATUS

[76] Inventor: Leif Lundblad, Häradsvägen 102, S-141 41 Huddinge, Sweden

[21] Appl. No.: 792,958

[22] Filed: Oct. 30, 1985

[30] Foreign Application Priority Data

Nov. 16, 1984 [SE] Sweden ..... 8405765

[51] Int. Cl.[4] ..... B65H 5/00

[52] U.S. Cl. ..... 271/3; 271/9/162; 194/350; 232/43.2

[58] Field of Search ..... 271/3, 9, 162, 163, 271/164, 10, 181, 4, 210; 221/6; 194/350; 232/43.1, 43.2, 15, 16

[56] References Cited

U.S. PATENT DOCUMENTS

| | | | |
|---|---|---|---|
| 2,759,729 | 8/1956 | Hedlun | 271/10 |
| 3,807,628 | 4/1974 | Bock | 232/16 |
| 4,045,017 | 8/1977 | Lundblad | 271/181 |
| 4,066,253 | 1/1978 | Lundbald et al. | 271/4 |
| 4,113,140 | 9/1978 | Graef et al. | 271/210 X |
| 4,283,097 | 8/1981 | Lundblad | 271/145 X |
| 4,312,277 | 1/1982 | Graef et al. | 221/6 X |
| 4,434,931 | 3/1984 | Hunt et al. | 232/15 |

*Primary Examiner*—Richard A. Schacher

*Attorney, Agent, or Firm*—Sughrue, Mion, Zinn, Macpeak and Seas

[57] ABSTRACT

An automatic banknote depositing apparatus has a housing (1) and a mechanism for transporting banknotes from an infeed opening to a cassette (11). The infeed opening is covered by one (14) of a plurality of insert devices when the apparatus is complete. The housing has a recess located adjacent the infeed opening to accommodate the insert device, which is provided with a plate (21) for bringing pressure to bear mechanically against banknotes, and a keyboard for controlling the apparatus. One of the insert devices forms, together with the housing an externally accessible opening (10*c*) for the manual insertion of banknotes. The insert device has a vertically displaceable bottom member (22) which, when occupying its upwardly displaced position, forms an inclined surface which extends down to the infeed opening. Another of the insert devices (40) incorporates a slatted roll-shutter (42) which can be moved automatically into and out of the body of the insert device and which when only partially inserted exposes a narrow opening through which banknotes can be manually inserted. When fully inserted exposes a large opening through which a cassette can be inserted. The pressure plate can be dropped down automatically in the bottom member when the slatted roll-shutter is fully displaced into the insert device.

3 Claims, 9 Drawing Figures

AUTOMATIC BANKNOTE DEPOSITING APPARATUS

TECHNICAL FIELD

The present invention relates to an automatic banknote depositing apparatus, and more specifically to such an apparatus incorporating, in one and the same casing, transport means for transporting banknotes from an infeed, or deposit opening, to a cassette, one or more cassettes for storing banknotes deposited through the infeed opening; and counting and sensing means for counting the number of banknotes deposited and examining the banknotes for the purpose of detecting possible forgeries and the occurrence of double-feeding.

BACKGROUND ART

Prior art automatic banknote depositing apparatus of this kind differ quite considerably in design and in their method of operation. Thus, the design of the apparatus is contingent on the intended operational mode of the apparatus, i.e. whether the apparatus is to be used for (a) depositing banknotes manually; (b) depositing banknotes etc. with the aid of cassettes; or (c) whether it is intended for use by the general public; or (d) by bank and post office personnel; which, in the main, renders the handling of banknotes more expensive and more complicated.

It is previously known to construct automatic banknote depositing apparatus which incorporate transport means for transporting banknotes from an infeed or deposit opening to a cassette, which is locked mechanically and electronically and opened subsequent to being deposited in the apparatus, and then again locked and sealed when withdrawn from the apparatus. Such automatic banknote depositing apparatus are described, for example, in U.S. Pat. Nos. 4,045,017 and 4,283,097.

When feeding sheets from a bundle of sheets it is known to bring pressure means to bear against the bundle in a manner such as to feed the sheets correctly irrespective of whether said sheets (banknotes) are new, old, worn, thin or thick. This is achieved by consciously controlling movement of the pressure means in dependence on distances in space or time between sequentially dispensed sheets, see for example U.S. Pat. No. 4,252,251.

When depositing and dispensing banknotes through automatic cash dispensing or depositing apparatus, it is important that checks can be made to ensure that two banknotes are not dispensed or deposited at the same time and also that the banknotes concerned are genuine, i.e. not forgeries. An example of automatic apparatus incorporating doublefeed control is illustrated and described in U.S. Pat. No. 4,066,253. A large number of photo-cell controlled apparatus are available for banknote authenticity checks, these apparatus operating by passing light through the banknotes or sensing light reflected therefrom, and are adapted, or can be adapted to the banknotes of different countries and for different characteristic signatures of the banknotes concerned, such as the watermark in the banknote, metal filaments incorporated therein, distinguishing colour combinations etc..

SUMMARY OF THE INVENTION

In a complete automatic banknote depositing apparatus of the aforementioned kind, the infeed opening of the casing housing the apparatus is covered by one or more insert members adapted to the apparatus. The casing housing the apparatus is also provided with a slot adapted to receive the insert members one at a time, each of said insert members being provided with pressure means effective to urge the banknotes into contact with a belt, wheels or rollers incorporated in the transport means, at a suitable pressure herefor.

An automatic banknote depositing apparatus constructed in this manner can be readily adapted for manual infeed of banknotes or cassette-based infeed of banknotes, or optionally for both manual and cassette-based infeed. In addition, the automatic banknote depositing apparatus according to the invention fulfils the various requirements which can be placed on such apparatus with respect to its use by the general public or the personnel of banks, post offices and businesses, i.e. when the apparatus may be expected to be used a very large number of times with relatively few (at most 100) banknotes being deposited at any one time, or when the apparatus may be expected to be used a fewer number of times with a large number (thousands) of banknotes being deposited each time, possibly in cassettes.

BRIEF DESCRIPTION OF THE DRAWINGS

The invention will now be described in more detail with reference to the accompanying drawings, in which.

PREFERRED EMBODIMENTS OF THE INVENTION

Figure 1:
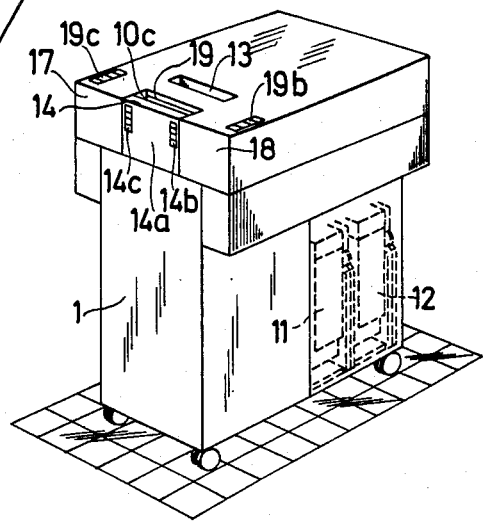
FIG. 1 illustrates an automatic banknote depositing apparatus according to the invention, illustrating the outer casing housing the apparatus, and one of a plurality of insert devices.
Figure 1A:
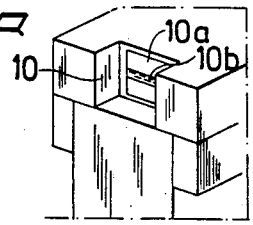
FIG. 1*a* illustrates an infeed opening provided in the casing illustrated in FIG. 1.

The automatic banknote depositing apparatus illustrated in FIG. 1 comprises a casing or housing 1 having arranged therein transport means (belts, rollers, wheels, and possibly a combination thereof) for transporting banknotes from an infeed opening 10*a* in the housing, see FIG. 1*a*, to a cassette 11 or 12, in which the deposited banknotes are stored, and counting and sensing means for counting the number of banknotes deposited and checking said banknotes for forgeries and double-feeding. When the apparatus is complete, the infeed opening 10*a* is covered by insert device 14, which fits into recess 10 in the housing, see FIG. 1*a*. The insert device comprises partly a front plate 14*a*, which supplements the front parts 17,18 of the housing 1, partly a pressure means in the form of a plate (not visible in FIG. 1) which is intended to exert controllable pressure on a bundle of banknotes 19 deposited in the banknote depositing apparatus, and partly two activating means (button arrays) 14*b*,*c*, one at each end of the plate 14*a* in the proximity of the front parts 17 and 18. The front plate 14*a* thus defines recess 10 outwardly, and together with the parts defining the housing forms an externally accessible opening 10*c* through which banknotes can be inserted. A second transportation means is arranged in the housing 1, for transporting back to an outfeed opening 13 on the upper side of the housing banknotes which have been found to be forged or damaged, and also banknotes which have been the subject of a so-called double-feed, i.e. when two banknotes are fed one against the other.

The aforedescribed automatic banknote depositing apparatus is intended to service two cashiers at the same time. When a plurality of banknotes (a bundle) are to be fed into the apparatus, one of the cashiers inserts a bundle of banknotes into the opening 10*c* and presses the nearest start button, for example 14*b*, whereupon the transport means begins to transport the banknotes, one at a time past the counting and sensing means, and then to a cassette intended for receiving said banknotes, provided that no double-feed has been detected, or unsuitable banknotes.

When, for example, the sensors detect a double-feed situation, or when a customer wishes the bundle of banknotes to be returned to him/her, due to disagreement on the number of banknotes contained in the bundle, the second transport means is brought into operation, therewith enabling the bundle of banknotes to be withdrawn from the outfeed opening 13. In the event of two banknotes being fed-in in overlapping or superimposed relationship, i.e. so-called double-feed, the second transport means is automatically placed out of function; the cashier is able to start the second transport means, if and when desired, by activating the keyboard 14*b*. The number of banknotes concerned in a transaction can be checked on a counting device 19*b* and 19*c* respectively.

Figure 2:
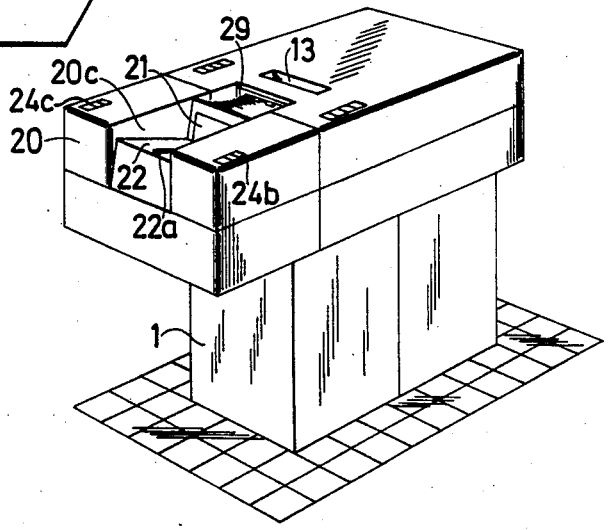
FIG. 2 is an automatic banknote depositing apparatus intended for banks and post offices and constructed for manual infeed of banknotes (manual service)

The automatic banknote depositing apparatus illustrated in FIG. 2 comprises the housing or casing 1 illustrated in FIG. 1 and an insert device 20 of more comprehensive design than the insert device 14 of the FIG. 1 embodiment. The banknote depositing apparatus illustrated in FIG. 2 is intended for manually depositing relatively large bundles of banknotes, and also bankbooks and post-office books, pass-books etc.

The insert device 20 has a large, externally accessible opening 20*c* which is defined at the bottom thereof by a vertically displaceable (upwardly rotatable) bottom member 22 which, when in an upwardly displaced position, forms a sloping surface extending downwardly towards the infeed opening 10*a* of the housing or casing 1. This opening is hidden from view in the FIG. 2 illustration by a bundle of banknotes 29, which are pressed towards the infeed opening by means of a plate 21, which can be displaced obliquely downwardly towards the infeed opening 10*a* in a controlled manner with the aid of an attachment means (hidden from view in FIG. 2) passing through a groove or slot 22*a* in said bottom member 22. By controlled displacement of the plate 21 is meant here that the plate is displaced in dependence on the distance in time and space between sequential banknotes as they pass through the housing 1 in their travel to one of the cassettes. In this way, the bundle of banknotes can be subjected to a pressure force of suitable magnitude with respect to the size and condition of the banknotes. When inserting a bundle of banknotes, the cashier places the bundle on the bottom member 22 and presses a start button on, for example, the key bank 24*b*, whereupon the plate 21 is immediately displaced automatically downwards towards the bundle 29.

In the manner previously described with reference to FIG. 1, the banknotes are transported singly through the system of devices to a selected cassette. If desired or required, however, the bundle of banknotes, optionally in the form of a plurality of part bundles, can be fed back to the outfeed opening 13. When the bundle is split into part bundles, each part bundle can be fed from the apparatus in turn in a known manner, in which a subsequent part bundle is not returned to the opening 13 until a preceding bundle has been removed therefrom.

Figure 3:
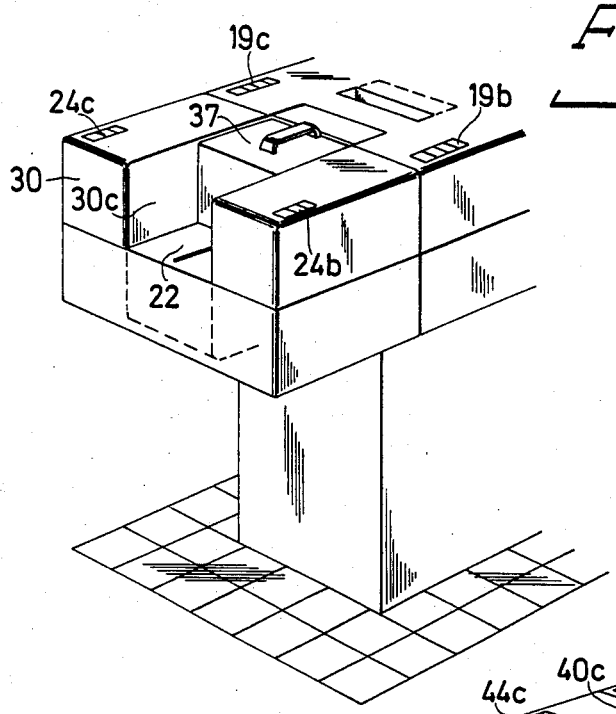
FIG. 3 illustrates the apparatus shown in FIG. 2 when adjusted for the infeed of banknotes with the aid of cassettes.

FIG. 3 illustrates the automatic banknote depositing apparatus shown in FIG. 2 with the bottom member 22 displaced downwardly to a horizontal position and with the plate 21 removed, optionally automatically dropped down into said bottom member 22, in a manner to afford space for a cassette 37 containing banknotes to be deposited or fed to cassettes in the apparatus, optionally for sorting the banknotes therein. The situation envisaged may be one in which a company officer enters the bank with a cassette containing banknotes, the cassette being placed by the cashier in the manner shown in the FIGURE. The cashier then presses the start button 24*b* and reads-off the number of banknotes recorded on the counting device 19*b* etc. The externally accessible opening 30*c* is so formed that when the cassette is inserted into the depositing apparatus in the manner intended the end of the cassette facing towards the infeed opening 10*a* (hidden from view) of the housing 1 extends slightly into the housing and cannot therefore be reached from outside the apparatus while banknotes are being fed thereinto. The cassette 37 is, in other respects, of the kind which is intended to be closed and locked when placed in the opening 30*c* and to be opened in this position electronically so as to enable the transporting elements (belts, rollers) 10*b* of the transport means to feed the banknotes from the cassette and transfer the same to a cassette or cassettes provided in the apparatus to this end. When the cassette 37 is subsequently withdrawn, the cassette is closed and locked automatically in readiness for further use in the premises of the company official.

Figure 5:
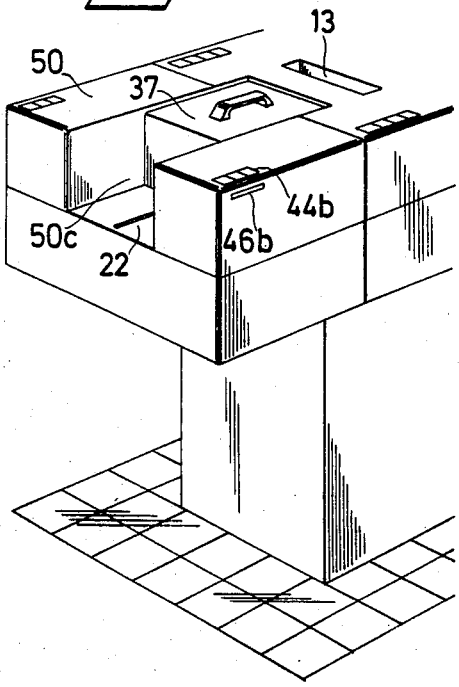
FIG. 5 illustrates the apparatus shown in FIG. 4 adapted for cassette operation.
Figure 6:
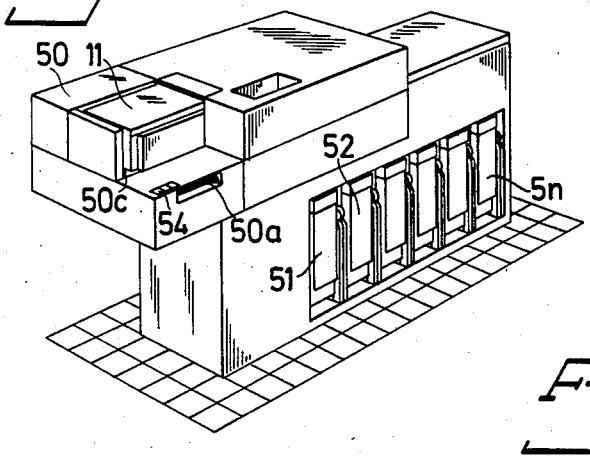
FIG. 6 illustrates an apparatus similar to that shown in FIG. 3 but modified to receive a large number of banknotes.
Figure 7:
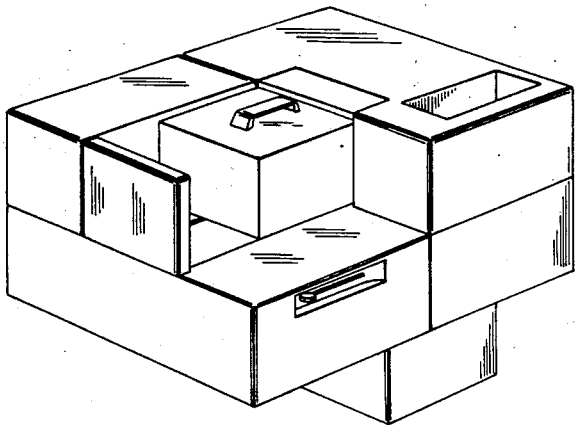
FIG. 7 illustrates part of the apparatus shown in FIG. 6, but with a different kind of cassette.

The cassette, which can be said to constitute a part of the insert device, is provided here, and also with the arrangements illustrated in FIGS. 5, 6 and 7, with requisite pressure means for applying the necessary pressure to the banknotes present therein.

Figure 4:
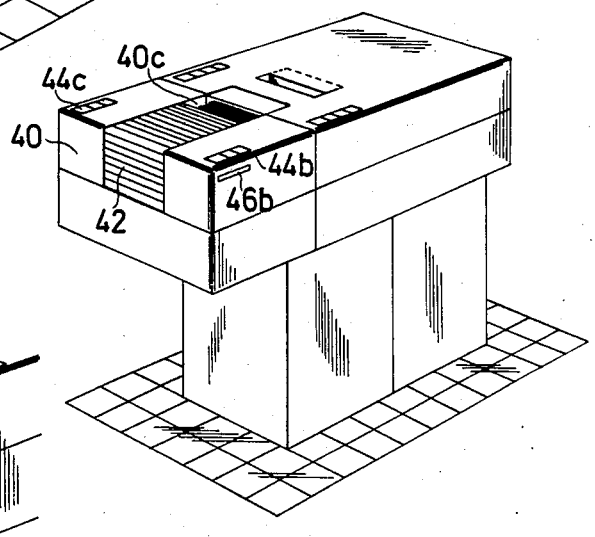
FIG. 4 illustrates a modified automatic banknote depositing apparatus provided with an insert device incorporating a roll-shutter.

FIG. 4 illustrates an automatic banknote depositing apparatus having an insert device 40 provided with a slatted roll-shutter 42 which can be displaced into and out of said device and which when occupying a fully extended position totally covers a banknote infeed opening 40*c*, which is made accessible by lifting the shutter. The infeed of banknotes to one or more cassettes is effected by transport means provided in the housing or casing, provided that the opening 40*c* is fully covered by means of the slotted rollshutter 42.

The roll-shutter 42 is arranged so that it can be moved into the insert device to only a small extent, so as to leave an externally accessible narrower opening 40*c*, as illustrated in FIG. 4, or to an extent which presents a substantially larger opening to enable a much thicker bundle of banknotes to be inserted thereinto, preferably placed in a cassette. The insert device 40 has two card openings, one on either side of the device, of which openings one, 46*b*, is shown in FIGS. 4 and 5. Customers which can be normally expected to deposit smaller numbers of banknotes per bundle (e.g. a maximum of 100 banknotes in each bundle) are provided with cards which when inserted into one of the card openings causes the slatted roll-shutter 42 to be displaced to an extent which exposes a smaller part of the opening 40*c*, commensurate with the thickness of the bundle. Other customers, for example officials of companies having a large daily turnover, are provided with cards programmed to cause the slatted roll-shutter 42 in the insert device to be displaced in a manner to present a much larger opening 50*c*, see FIG. 5. In the former case, the bottom member 22 is displaced upwardly and a pressure means (plate) 21 is arranged in the manner illustrated in FIG. 2; in the latter case the bottom member 22 is horizontal and the plate 21 automatically dropped in the bottom 22, to afford room for the cassette 37. A pressure means provided in the cassette exerts the requisite pressure against the banknotes.

In the embodiment illustrated in FIG. 4, a customer has inserted his/her card into the opening 46*b* and the slatted roll-shutter has therewith been moved partially into the insert member 40, to expose a small opening 40*c*. Subsequent to the customer inserting a bundle of banknotes and pressing a button on the keyboard 46*b*, the shutter 42 is automatically moved out of the insert device so as to cover the opening 40*c*. The transport means provided within the housing 1 begin to transport banknotes, one at a time, past a counting means, and the customer is able to readoff from the counting device 19*b* the number of banknotes counted before said banknotes are transported to one or more cassettes in the housing or casing, this final transportation of the banknotes being effected subsequent to the customer re-pressing the start button on the keybank. The customer is issued with a receipt for the number and/or the value of the banknotes deposited, this receipt being delivered through the outfeed opening 13.

In the embodiment illustrated in FIG. 5 it is assumed that a customer (company official) has inserted his/her card into the card opening 46*b* and the slatted roll-shutter 42 has subsequently been displaced fully into the insert device 40 and the bottom member 22 has been moved down to its horizontal position and the pressure plate 21 has dropped down. Subsequent to the customer placing a cassette into the opening 50*c* and pressing the start button on the key bank 44*b*, the banknotes are fed into the apparatus in the previously described manner. When all of the banknotes have been fed into the apparatus, the customer removes the cassette 37, whereupon the pressure plate is lifted and the shutter displaced automatically from the insert device, so as to again fully close the opening 50*c*. The apparatus illustrated in FIG. 6 is intended for sorting banknotes collected in a cassette 11. The housing or casing 1 of the apparatus incorporates a plurality of cassettes 51,52 . . . 5*n*, each of which is intended to receive banknotes of a given value, for example 10 kr, 50 kr, 100 kr, 1000 kr. The insert device 50 is particularly constructed for receiving cassettes of a given standard type which are connected mechanically-electronically to the apparatus by activating a knob or handle 50*a* of the same kind as that used for the cassettes 51,52 . . . 5*n* in the housing or casing 1.

The cassettes 11 are placed in the externally accessible space 50*c* and are activated mechanically by moving the knob 51*a* from left to right, to the position illustrated in the drawing. As a result hereof, the end of the cassette facing the casing or housing 1 is opened, thereby making the banknotes accessible to the transport means, which then transports the banknotes in the aforedescribed manner. The transport means is activated by pressing the start button 54, wherewith the banknotes are counted and sorted in respect of their different values, whereafter the respective sorted bundles are fed to a respective cassette 51,52 . . . 5*n*.

Figure 8:
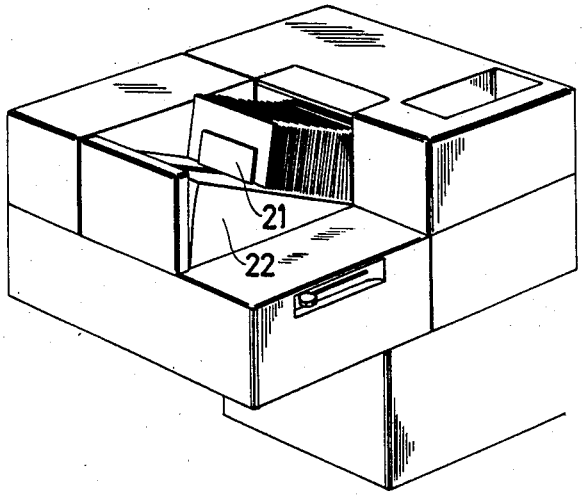
FIG. 8 illustrates the same part of the apparatus shown in FIG. 7 but modified for the manual infeed of banknotes.

The automatic banknote depositing apparatus can also be used for smaller cassettes, see FIG. 7, or for manually depositing banknotes, see FIG. 8. In this latter case the bottom 22 of the insert device is displaced upwardly to form a sloping surface and the pressure plate 21 is lifted in the aforedescribed manner.

I claim:

1. An automatic banknote depositing apparatus comprising a housing (1), transport means for transporting banknotes from an infeed opening (10*a*) to one of a plurality of cassettes (11, 12) in the housing intended for storing deposited banknotes, and counting and sensing means for counting the number of banknotes deposited and for examining deposited banknotes with respect to authenticity and with respect to double-banknote feed, characterized in that the housing is arranged to co-act with a plurality of insert devices, each of which together with the housing forms a complete apparatus, in that, when the apparatus is complete, the infeed opening is covered by one of said insert devices (14, 20, 40), and in that the housing is provided in the proximity of the infeed opening with a recess (10) adapted to receive, one at a time, said insert devices (14, 20, 40) complementing said housing, each said insert device being provided with pressure applying means (21) arranged to urge banknotes mechanically against transport elements 10*b* incorporated in the transport means adjacent the infeed opening (10*a*) located in the recess, and each insert device, together with the housing, forming an externally accessible opening (10*b*) for the infeed of banknotes to said infeed opening, wherein the externally accessible opening (20*c*) formed by the insert device (20) is defined by a vertically displaceable bottom member (22) forming, when occupying an upwardly displaced position, an inclined surface extending towards the infeed opening of the housing.

2. An apparatus according to claim 1, wherein the pressure applying means comprises a plate removably arranged on said bottom member; and the insert device (20), in the absence of said plate (21) and with the bottom member in a downwardly displaced position, forms, together with the housing, an opening (30*c*) for a cassette (37) containing banknotes.

3. An automatic banknote depositing apparatus comprising a housing (1), transport means for transporting banknotes from an infeed opening (10*a*) to one of a plurality of cassettes (11, 12) in the housing intended for storing deposited banknotes, and counting and sensing means for counting the number of banknotes deposited and for examining deposited banknotes with respect to authenticity and with respect to double-banknote feed, characterized in that the housing is arranged to co-act with a plurality of insert devices, each of which together with the housing forms a complete apparatus, in that, when the apparatus is complete, the infeed opening is covered by one of said insert devices (14, 20, 40), and in that the housing is provided in the proximity of the infeed opening with a recess (10) adapted to receive, one at a time, said insert devices (14, 20, 40) complementing said housing, each said insert device being provided with pressure applying means (21) arranged to urge banknotes mechanically against transport elements (10*b*) incorporated in the transport means adjacent the infeed opening (10*a*) located in the recess, and each insert device, together with the housing, forming an externally accessible opening (10*b*) for the infeed of banknotes to said infeed opening, wherein one of said insert devices (30, 50) together with the housing (1) forms an externally accessible opening (30*c*, 50*c*) for receiving a cassette (37) containing banknotes, said cassette cooperating with said one insert device and being electronically lockable and automatically openable in a position immediately adjacent the infeed opening of the housing, but closed and locked when removed from the infeed opening.

* * * * *